United States Patent [19]

Born

[11] Patent Number: 4,919,311

[45] Date of Patent: Apr. 24, 1990

[54] PRESSURE VESSEL FOR SPRAYERS

[75] Inventor: Gerald W. Born, Eldora, Iowa

[73] Assignee: Quality Products, Inc., Eldora, Iowa

[21] Appl. No.: 598,905

[22] Filed: Apr. 10, 1984

[51] Int. Cl.[5] ..... B65D 83/00

[52] U.S. Cl. ..... 222/401; 222/184; 222/464

[58] Field of Search ..... 222/464, 478, 401, 402, 222/396, 397, 184, 173, 175; 220/70, DIG. 14; 215/1 C; 239/373

[56] References Cited

U.S. PATENT DOCUMENTS

| | | | |
|---|---|---|---|
| 2,082,146 | 6/1937 | Brandt | 222/402 |
| 2,748,992 | 6/1956 | Pinke et al. | 222/402 |
| 3,598,270 | 8/1971 | Adomaitis | 215/1 C |
| 3,719,232 | 3/1973 | Gubela | 220/DIG. 14 |
| 3,768,706 | 10/1973 | Hill | 239/373 |
| 3,825,145 | 7/1974 | Reynolds | 220/70 |
| 3,935,955 | 2/1976 | Das | 220/70 |
| 4,154,401 | 5/1979 | Thompson | 222/402 |
| 4,254,882 | 3/1981 | Yoshino | 220/70 |

FOREIGN PATENT DOCUMENTS

| | | | |
|---|---|---|---|
| 0027715 | 4/1981 | European Pat. Off. | 239/373 |

*Primary Examiner*—Kevin P. Shaver
*Assistant Examiner*—Gregory L. Huson
*Attorney, Agent, or Firm*—Kane, Dalsimer, Sullivan, Kurucz, Levy, Eisele and Richard

[57] ABSTRACT

An all plastic one piece blow molded pressure vessel and sprayer combination shows a bottom closure with upwardly inclined feet. Internal pressure causes the upward and inward portion of the feet to descend such that the feet remain in good contact with a planar surface on which the vessel is resting, such that the bottom does not become bulged outwardly and rock.

11 Claims, 3 Drawing Sheets

PRESSURE VESSEL FOR SPRAYERS

BACKGROUND OF THE INVENTION

Heretofore, garden sprayers normally featured a metallic tank containing a liquid to be pressurized by a hand pump for dispensing to the desired location in the prescribed spray pattern. In order to construct this tank several pieces, normally four in number, are required to be assembled and connected together, as for example, by a chime construction.

Metallic tanks for sprayers are faced with attendant problems and disadvantages including their ability to be readily dented and their ability to corrode under certain conditions of use, particularly as a result of corrosive liquids to be dispensed. In this connection, it is normally recommended that the corrosive liquid be removed from the tank overnight or when the tank is not being used for any extended period of time; and, of course, the tank is flushed in order to minimize the ability of the liquid contents to attack the metal of the tank.

As one will readily appreciate each chime represents a zone of weakness that could cause a failure of the tank or provide a potential zone for leakage. In connection with leaving the liquid contents within the metallic tank over prolonged periods of time in cold weather, the tanks have exploded when exposed to relatively low temperature conditions for appreciable periods of time.

SUMMARY OF THE INVENTION

The principal object of the present invention is to eliminate the drawbacks and disadvantages and problems inherent in the use of metallic drums for sprayers by providing a tank constructed of one-piece blow molded plastic material.

Another object is to provide a plastic tank of the foregoing type that resists corrosion, does not dent, and is lighter in weight.

A further object is to provide a plastic tank of the foregoing type that does not include any chime but rather is constructed of one-piece integral plastic material thereby eliminating all zones of weakness.

Still another object is to provide a plastic tank of the foregoing type that does not have to be painted and when the tank is removed from the blow mold during the molding process, the tank is a finished product.

A still further object is to provide a plastic tank that includes an integral funnel for filling and emptying the contents of the tank and which does not have to be emptied because of concern over corrosion or the ability of the contents freeze under low temperature conditions.

Another important object is to provide a plastic tank which includes a uniquely designed bottom that is specifically designed to resist the internal pressures generated elimination of rocking of the tank when rested on a horizontal surface.

Others objects and advantages will become apparent from the following detailed description which is to be taken in conjunction with the accompanying drawings.

DETAILED DESCRIPTION OF THE PREFERRED EMBODIMENT

Figure 1:
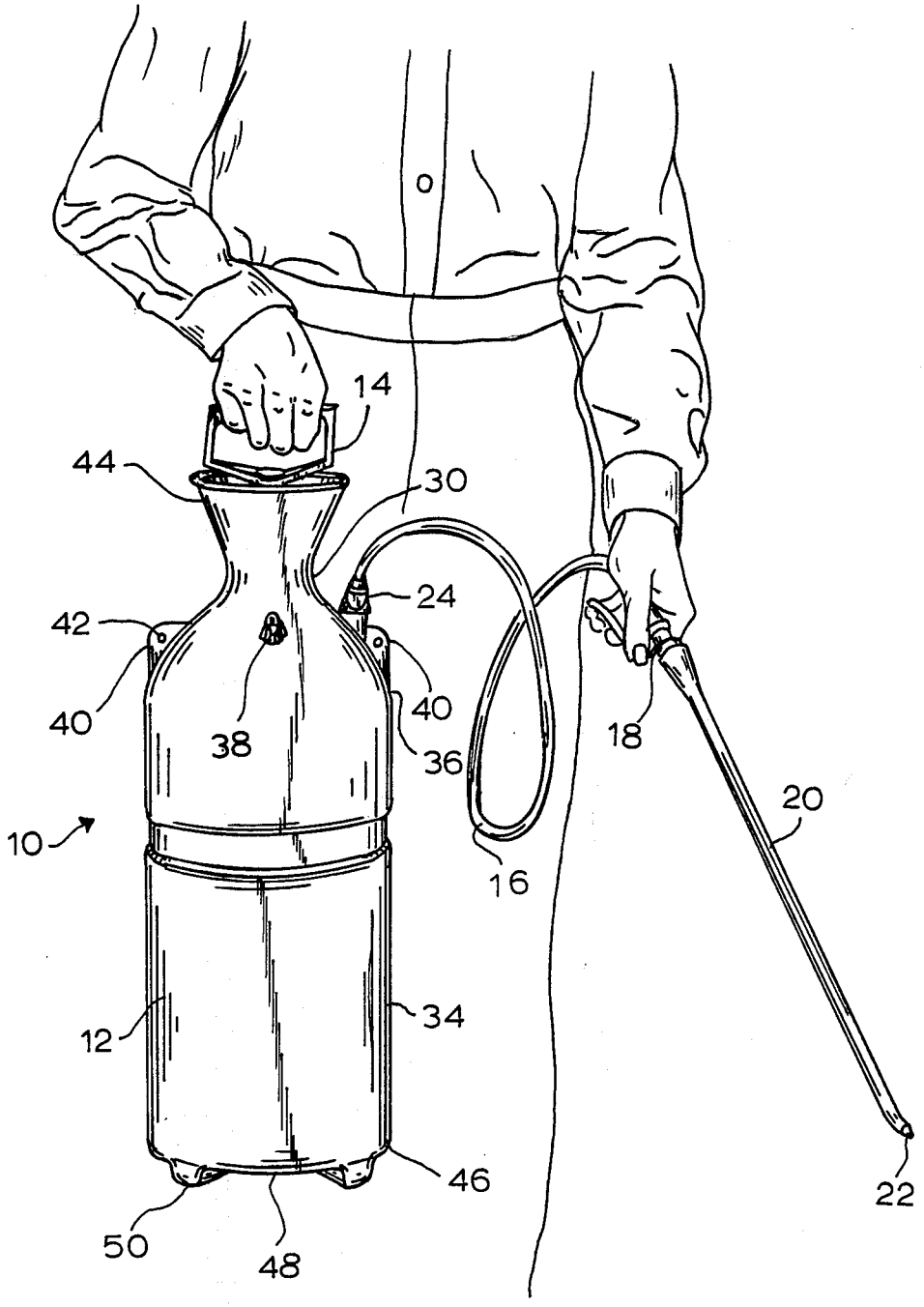
FIG. 1 is a perspective view of a garden sprayer in use having a plastic tank constructed in accordance with the present invention.

In the drawings, a sprayer 10 is shown being particularly effective for the control of insects, disease and weeds and for use in the yard, garden and home. The sprayer 10 includes the tank or vessel 12 incorporating the teachings of the present invention, pump 14 for pressurizing the contents of the tank 12, hose 16 extending from the tank and terminating in a spray control valve 18 which is coupled with an extension 20 having an adjustable nozzle 22 for obtaining the desired in a spray pattern. In this connection, the nozzle 22 may be adjusted to provide a mist on the one hand to a stream on the other for projection over relatively long distances. The spray control valve 18 may be readily rotated and turned to aim the extension 20 and consequently the nozzle 22 to the selected target. The valve 18 may be actuated by depressing the illustrated valve control handle in a manner well known in the art. The hose 16 may be formed of vinyl for purposes of resisting corrosion and wear. The hose 16 is also readily removable from the tank 12 for servicing and towards this end a coupling 24 may be utilized for such purposes, that not only connects with a threaded boss 26 of the tank 12 but communicates the hose 16 with a supply tube 28 extending interiorly of the tank 12. The pump 14 is preferably fabricated of plastic material and is well known in the art and is designed to resist corrosion and provide relatively fast easy pump-up and pressurization of the tank interior. The pump 14 is conveniently and most advantageously secured to the neck 30 of the tank 12 by means of the meshing threads 32 of both the tank neck and the pump exterior.

Reference is now made to the tank 12 which is preferably fabricated of one-piece integral plastic material by means of blow molding. A successful material for purposes of fabricating the tank 12 is polyethylene. The tank 12 is provided with a substantially cylindrical side wall 34 of any prescribed height depending on the desired capacity of the tank 12, which according to successful embodiments of the invention has capacities of 2 and 3 gallons. At the top 36 of the side wall 34 the vessel converges into the narrowed neck 30. At this necked-in portion appears the threaded boss 26 and a pressure relief valve 38 for relieving internal pressure of the tank 12 when a predetermined upper limit is exceeded. A pair of opposed ribs 40 having through holes 42 may also be integrally formed at the necked-in portion to permit the tank and the entire sprayer to be suspended by means of integral relatively big deep integral funnel 44, which advantageously provides for relatively easy, no-spill filling of the tank 12.

Figure 2:
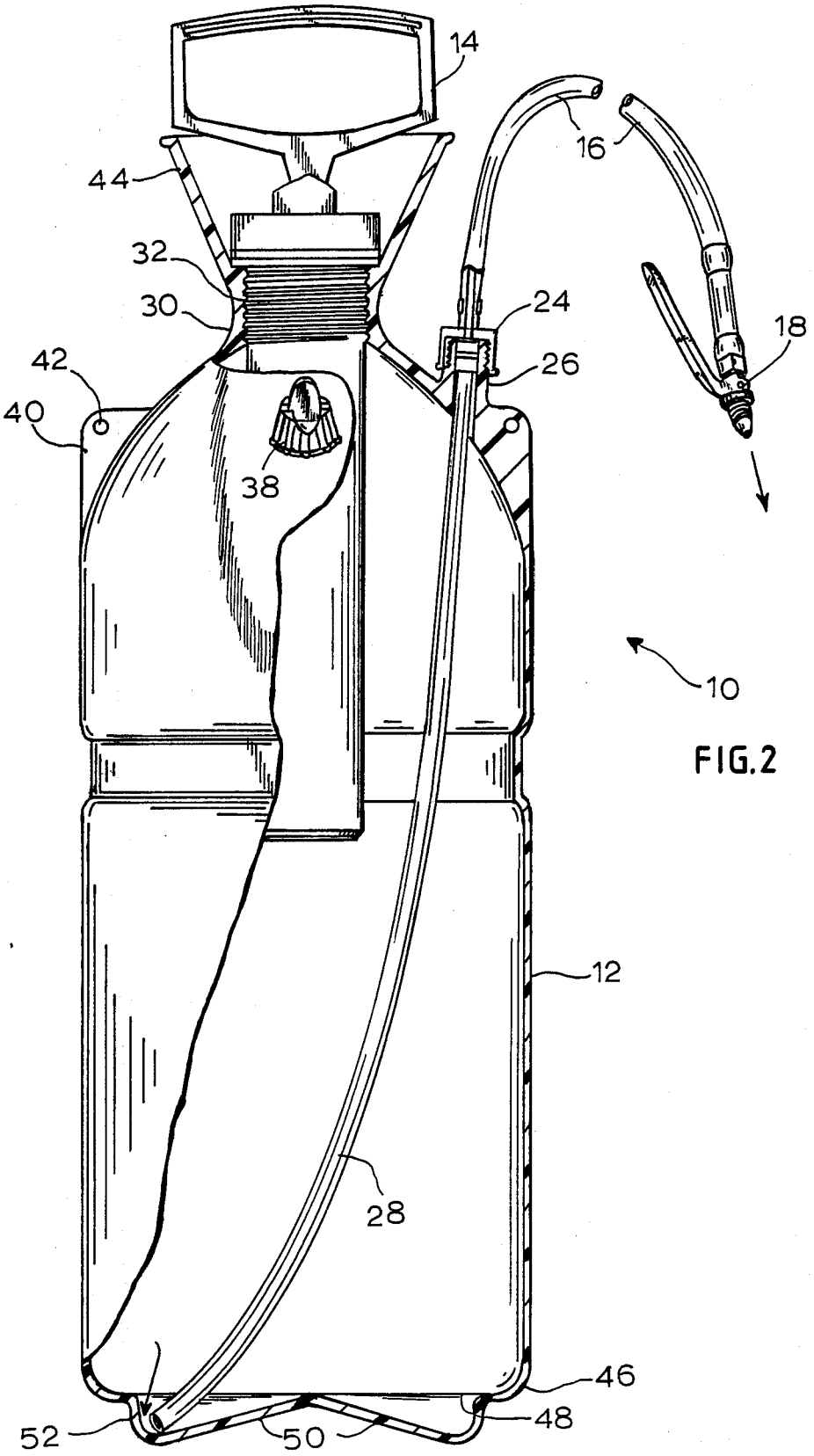
FIG. 2 is an enlarged elevational view thereof with certain parts broken away, removed and sectioned.
Figure 3:
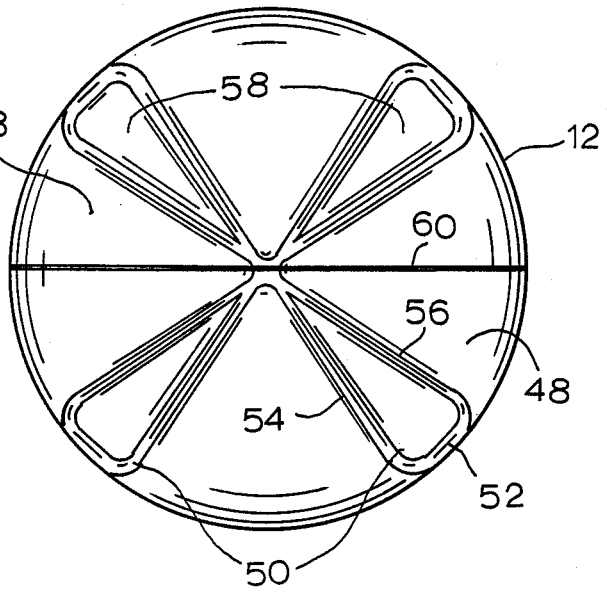
FIG. 3 is a bottom plan view of the plastic tank.
Figure 4:
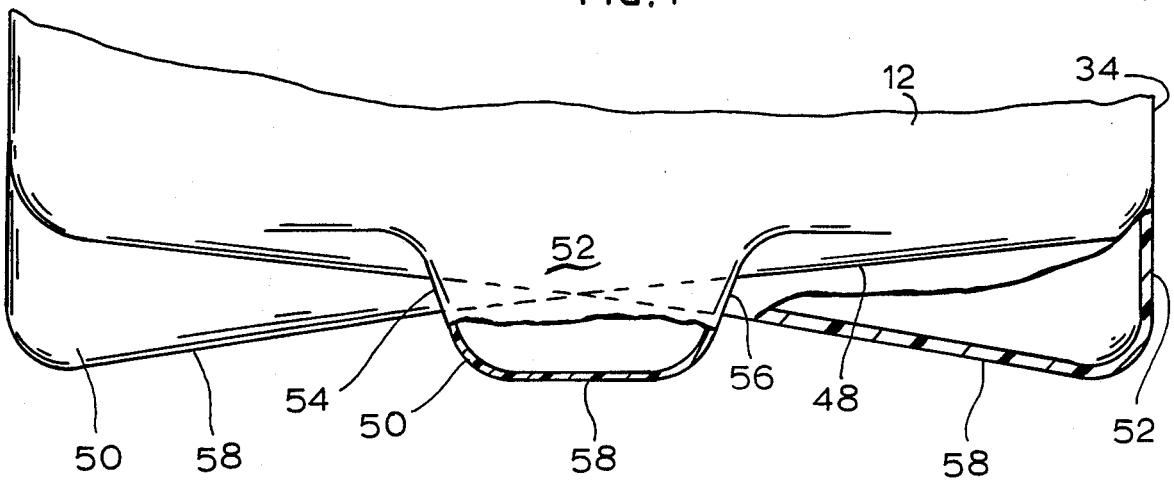
FIG. 4 is an enlarged fragmentary and partially sectional view of the tank bottom.

The bottom 46 of the side wall 34 is integral with bottom closure 48. This bottom 48 is slightly domed outwardly to resist internal pressure. In addition, the bottom is provided with four triangularly shaped legs 50, each of which includes an end wall 52, side walls 54 and 56 which extend from the end wall 52 radially inwardly to approximately the center or axis of the bottom closure 48 as well as the tank side walls 34. The bottom wall 58 of each leg is triangular and is inclined upwardly from the base of the end wall 52 towards the center of the bottom closure 48. As is clearly shown in FIG. 2 the bottom of the tube 28 may rest interiorly of one of the feet 50. The ribs 50 cooperate in reinforcing the bottom closure to resist the tank internal pressure. In this regard the feet 50 when subjected to internal pressure tend to flatten out to a location short of being horizontal. In this connection, pressures of approximately 680 psi at the bottom 48 has been satisfactorily resisted and particularly as a result of the provision of the upwardly and inwardly inclined feet 50. It should also be noted that the blow mold parting line 60 (see FIG. 3) is preferably located intermediate the feet 50. In this manner, the thickness of plastic forming each feet 50 is uniform so that under internal pressure, equal expansion of each feet 50 is assured, thereby minimizing if not reducing, the ability of the vessel or tank 12 to be rocked on its feet 50.

Thus, the sprayer of the present invention may simply be filled through the funnel 44 after removing the pump 14 which is then replaced and actuated to pressurize the interior of the tank 12. Thereafter, the contents of the tank 12 may be readily dispensed by actuating the spray control valve 18. Most importantly, the sprayer and particularly the tank 12 of the present invention may be utilized year-round without concern over corrosion or freezing conditions and consequent bursting of the tank.

Thus, the several aforenoted objects and advantages are most effectively attained. Although a single somewhat preferred embodiment of the invention has been disclosed and described in detail herein, it should be understood that it is in no sense limited thereby and its scope is to be determined by that of the appended claims.

What is claimed is:

1. An all plastic, one-piece blow molded pressure vessel for a sprayer comprising in combination:

a substantially cylindrical side wall having a top and bottom;

a relatively reduced neck at and integral with the top of the side wall having pump coupling means for receiving a manually operated pump for pressuring the contents of the vessel;

an outwardly and upwardly flared funnel integral with the neck;

a hose coupling means near the top of the side wall for coupling with a hose for passage of the contents of the vessel under pressure;

a pressure relief valve coupling means for receiving a pressure relief valve for relieving pressure within the vessel that extends a predetermined value;

a bottom closure integral with the bottom of the side wall, the bottom closure being slightly dome-shaped to cooperate in resisting internal pressures, the bottom closure including a plurality of downwardly projecting and radially extending feet, each foot having a planar bottom face, spaced and opposed side faces and a circumferentially extending outer end face, each of the bottom faces being triangularly shaped meeting at a common location along the axis of the cylindrical wall, the bottom face being integral with the end face and extending from the end face radially inwardly and upwardly in a plane at a predetermined acute angle with a plane extending perpendicularly with the axis of the cylindrical side wall, whereby the feet cooperate in resisting internal pressures and in so doing are displaced so that the bottom face forms a smaller acute angle with the plane extending perpendicularly with the axis of the cylindrical side wall.

2. The invention in accordance with claim 1, wherein four of said feet are provided at the bottom of the vessel.

3. The invention in accordance with claim 1, wherein the mold parting line is located between the feet so that under internal pressure the feet will expand and deflect substantially equally so that there will be no rocking of the vessel when the feet rest on a horizontal surface.

4. An all plastic, one-piece blow molded vessel comprising in combination:

a substantially cylindrical side wall having a top and bottom; and a bottom closure integral with the bottom of the side wall, the bottom closure being slightly dome-shaped to cooperate in resisting internal pressures, the bottom closure including a plurality of downwardly projecting and radially extending feet, each foot having a planar bottom face, spaced and opposes side faces and a circumferentially extending outer end face, each of the bottom faces being triangularly shaped meeting at a common location along the axis of the cylindrical wall, the bottom face being integral with the and face and extending from the end face radially inwardly are upwardly in a plane at a predetermined acute angle with a plane extending perpendicularly with the axis of the cylindrical side wall, whereby the feet cooperate in resisting internal pressures and in so doing are displaced so that the bottom face forms a smaller acute angle with the plane extending perpendicularly with the axis of the cylindrical side wall.

5. The invention in accordance with claim 4, wherein four of said feet are provided at the bottom of the vessel.

6. The invention in accordance with claim 4, wherein the mold parting line is located between the feet so that under internal pressure the feet will expand and deflect substantially equally so that there will be no rocking of the vessel when the feet rest on a horizontal surface.

7. The invention in accordance with claim 4, further comprising:

a relatively reduced neck at and integral with the top of the side wall having pump coupling means for receiving a manually operated pump for pressuring the contents of the vessel.

8. The invention in accordance with claim 4, further comprising:

an outwardly and upwardly flared funnel integral with the neck.

9. The invention in accordance with claim 4, further comprising:

a hose coupling means near the top of the side wall for coupling with a hose for passage of the contents of the vessel under pressure.

10. The invention in accordance with claim 4, further comprising:

a pressure relief valve coupling means for receiving a pressure relief valve for relieving pressure within the vessel that exceeds a predetermined value.

11. The invention in accordance with claim 4, further comprising:

a relatively reduced neck at and integral with the top of the side wall having pump coupling means for receiving a manually operated pump for pressurizing the contents of the vessel;

an outwardly and upwardly flared funnel integral with the neck; and a hose coupling means near the top of the side wall for coupling with a hose for passage of the contents of the vessel under pressure.

* * * * *